United States Patent [19]

Daley et al.

[11] Patent Number: 5,073,052

[45] Date of Patent: Dec. 17, 1991

[54] REUSEABLE INK RIBBON CASSETTE ADJUSTABLE TO DIFFERENT RIBBON WIDTHS AND METHOD OF USE

[75] Inventors: Phillip B. Daley, Cincinnati; Richard D. Puckett, Miamisburg, both of Ohio

[73] Assignee: NCR Corporation, Dayton, Ohio

[21] Appl. No.: 659,769

[22] Filed: Feb. 23, 1991

[51] Int. Cl.[5] ..... B41J 35/28

[52] U.S. Cl. ..... 400/208; 242/197

[58] Field of Search ..... 400/194, 196–197, 400/207, 208, 246, 247; 242/197–199

[56] References Cited

U.S. PATENT DOCUMENTS

| | | | |
|---|---|---|---|
| 3,236,468 | 2/1966 | Foret | 242/198 |
| 3,348,784 | 10/1967 | Gardiner et al. | 242/197 |
| 3,482,684 | 12/1969 | Schladale | 400/208 |
| 4,502,801 | 3/1985 | Hefti et al. | 400/208 |
| 4,531,690 | 7/1985 | Condy | 242/197 |
| 4,605,325 | 8/1986 | Hofmann | 400/207 |
| 4,776,714 | 10/1988 | Sugiura et al. | 400/248 |
| 4,971,462 | 11/1990 | Mueller et al. | 400/208 |
| 4,974,977 | 12/1990 | Morgan et al. | 400/208 |
| 4,990,008 | 2/1991 | Hwang | 400/208 |
| 4,998,834 | 3/1991 | Taylor | 400/247 |

FOREIGN PATENT DOCUMENTS

| | | | |
|---|---|---|---|
| 2057510 | 8/1971 | Fed. Rep. of Germany | 242/197 |
| 2365589 | 9/1975 | Fed. Rep. of Germany | 242/199 |

*Primary Examiner*—Eugene H. Eickholt

*Attorney, Agent, or Firm*—Matthew R. Jenkins

[57] ABSTRACT

A reuseable ink ribbon cassette which is capable of accommodating ink ribbons having different widths. The ink ribbon cassette comprises a first cover member, a second cover member and a plurality of support shafts for adjustably and detachably securing the first and second cover members together. The first and second cover members each have a plurality of seats for rotatably supporting an ink ribbon supply spool and an ink ribbon take-up spool between the first and second cover members when the first cover member is detachably secured to the second cover member. The support shafts have a plurality of detents thereon which permit the first cover member to be adjustably and detachably secured a preselected distance away from the second cover member, thereby enabling the ribbon cassette to accommodate ink ribbons having different widths.

18 Claims, 4 Drawing Sheets

REUSEABLE INK RIBBON CASSETTE ADJUSTABLE TO DIFFERENT RIBBON WIDTHS AND METHOD OF USE

BACKGROUND OF THE INVENTION

1. Field of the Invention

This invention relates to an ink ribbon cassette, and more particularly, it relates to a reuseable ink ribbon cassette which is capable of accommodating ink ribbons having different widths.

2. Description of the Related Art

The use of ribbon cassettes in printers has become quite common. Ribbon cassettes are advantageous because they can be easily installed in and removed from the printer. A problem in the prior art is that the ink ribbons in the ribbon cassettes could not be easily replaced when the ink ribbon was worn out. Also, the ribbon cassettes of the prior art did not permit the ink ribbon to be replaced if, for example, the printer in which the ribbon cassette was going to be used required an ink ribbon which was wider or narrower than the ink ribbon which was originally installed in the ribbon cassette. Thus, a single ribbon cassette could not be used on different printers unless those printers required an ink ribbon having the exact same width. In addition, some printers in the prior art could accommodate ink ribbons having different widths; however, there was no ribbon cassette which permitted the ink ribbon in the ribbon cassette to be easily changed. Consequently, it was necessary to manufacture multiple ribbon cassettes for a single printer.

There is, therefore, a present need to provide a means for replacing an ink ribbon in a ribbon cassette for use in a printer which means is inexpensive, easy to implement, and not time consuming to use.

SUMMARY OF THE INVENTION

In one aspect, this invention includes a reuseable ink ribbon cassette which is capable of accommodating ink ribbons having different widths, said reuseable ink ribbon cassette comprising: a first cover member; a second cover member; bearing means located on the first and second cover members for rotatably supporting a ribbon supply spool and a ribbon take-up spool between the first and second cover members when the first cover member is detachably secured to the second cover member; and securing means for adjustably and detachably securing the first cover member and the second cover member a preselected distance away from each other; said preselected distance generally corresponding to the width of the ink ribbon; said securing means enabling the preselected distance to be adjusted in order to accomodate ink ribbons having different widths.

In another aspect, this invention comprises a reuseable ink ribbon cassette which is capable of accommodating ink ribbons having different widths, said reuseable ink ribbon cassette comprising: a first cover member; a second cover member; and securing means for adjustably and detachably securing the first cover member to the second cover member at a preselected distance corresponding to the width of the ink ribbon so that the first cover member is generally opposed and parallel to the second cover member.

An object of this invention is to provide a reuseable ribbon cassette having an ink ribbon which can be easily replaced.

Another object of this invention is to provide means for replacing an ink ribbon in a ribbon cassette with another ink ribbon having either the same or a different width.

Another object of this invention is to provide a reuseable ribbon cassette which permits a plurality of ink ribbons having different widths to be mounted in the reuseable ribbon cassette, thereby reducing tooling and material costs associated with producing more than one housing for the ribbon cassette.

Still another object of this invention is to provide a reuseable ribbon cassette which is easy and inexpensive to manufacture.

These advantages, and others, may be more readily understood in connection with the following specification, claims, and drawing.

DETAILED DESCRIPTION OF THE INVENTION

Figure 1:
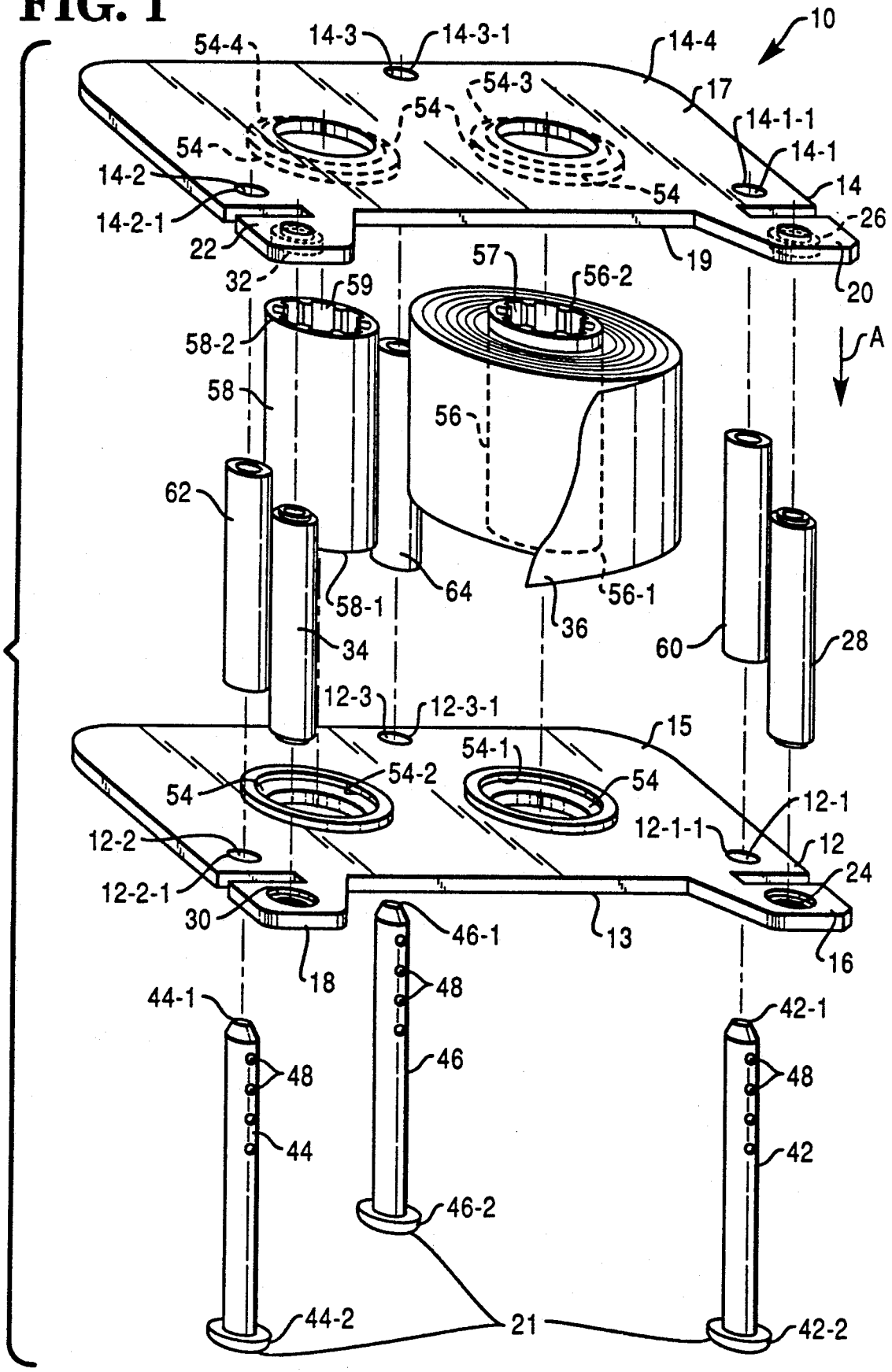
FIG. 1 is an exploded perspective view of a reuseable ribbon cassette according to the present invention.

FIG. 1 is an exploded perspective view of a reuseable ribbon cassette, hereinafter designated ribbon cassette 10, made according to the present invention. The ribbon cassette 10 comprises a first or bottom cover member 12 and a second or top cover member 14. The first cover member 12 has a first side 13 and a second side 15, and the second cover member 14 has a first side 17 and a second side 19. As best illustrated in FIG. 1, the first cover member 12 comprises a first arm portion 16 and a second arm portion 18, and the second cover member 14 comprises a third arm portion 20 and a fourth arm portion 22. The first, second, third and fourth arm portions 16, 18, 20 and 22 provide means for guiding an ink ribbon 36 to a print station (not shown) in a printer (not shown). The first and third arm portions 16 and 20 have a first recess 24 and a second recess 26, respectively, for receiving a first roller 28. The second and fourth arm portions 18 and 22 have a third recess 30 and a fourth recess 32, respectively, for receiving a second roller 34. The first and second rollers 28 and 34 are part of the guiding means, and they facilitate rotatably guiding the ink ribbon 36 to the print station (not shown) in the printer (not shown). In the embodiment being described, the ink ribbon could be any desired ribbon, such as a thermal transfer ribbon (not shown) or a one-time carbonless ribbon (not shown).

The first cover member 12 (FIG. 1) has a first aperture 12-1, a second aperture 12-2 and a third aperture 12-3 therein. The second cover member 14 has a fourth aperture 14-1, a fifth aperture 14-2 and a sixth aperture 14-3. As shown in FIG. 1, the apertures 12-1, 12-2, 12-3, 14-1, 14-2 and 14-3 are surrounded by walls 12-1-1, 12-2-1, 12-3-1, 14-1-1, 14-2-1 and 14-3-1, respectively. The ribbon cassette 10 includes securing means 21 for adjustably and detachably securing the first cover member 12 a preselected distance away from said second cover member 14, indicated by double arrow 52 in FIG. 3 so that the first cover member 12 is generally opposed and parallel to the second cover member 14. The preselected distance generally corresponds to the width of the ink ribbon 36. In a preferred embodiment, the securing means 21 comprises a first support shaft 42, a second support shaft 44 and a third support shaft 46. As best illustrated in FIG. 1, the first, second and third support shafts 42, 44 and 46 each have a plurality of spring-loaded bearings or detents 48 mounted thereon. Although the embodiment being described is shown with three support shafts 42, 44, and 46, the securing means 21 could be comprised of a fewer or greater number of support shafts if desired. Also, the support shafts 42, 44 and 46 could use any suitable fasteners in place of the detents 48, such as C-rings (not shown) or cotter pins (not shown). The function of the detents 48 will be described later herein.

Figure 5:
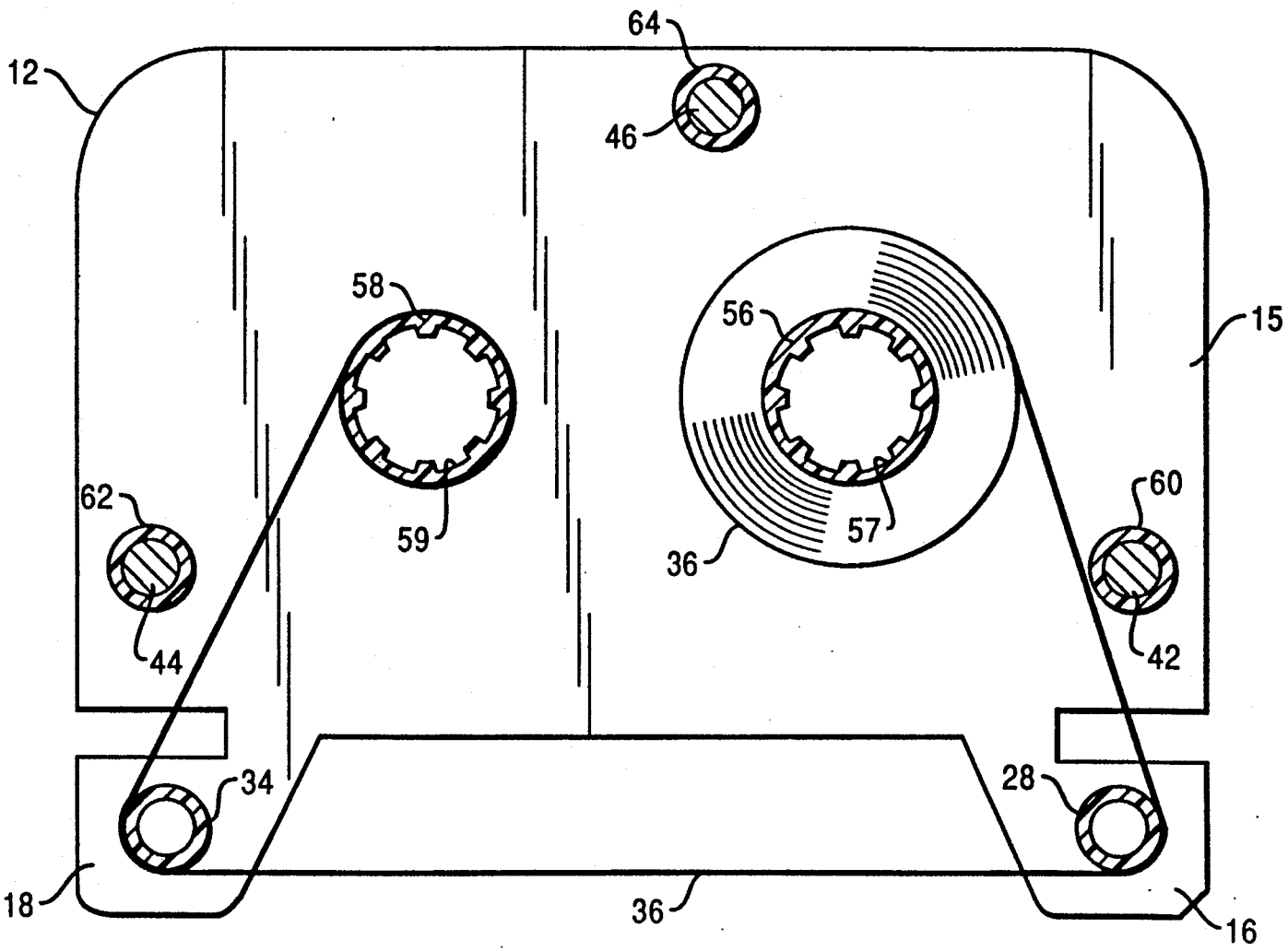
FIG. 5 is a sectional view of the ribbon cassette, taken along the line 5—5 in FIG. 4.

The first, second and third support shafts 42, 44 and 46 have one beveled end 42-1, 44-1 and 46-1, respectively, as illustrated in FIG. 1. The first, second and third support shafts 42, 44 and 46 have another end 42-2, 44-2, and 46-2, respectively, which is flat. In the embodiment being described, the first, second and third support shafts 42, 44 and 46 (FIG. 1) may have a first sleeve 60, a second sleeve 62 and a third sleeve 64, respectively, thereon. The first, second and third sleeves 60, 62, and 64 are mounted on the first, second, and third support shafts 42, 44 and 46, respectively, between the first and second cover members 12 and 14, as best shown in FIGS. 1 and 5. In the embodiment being described, the length of the first, second and third support sleeves 42, 44 and 46 is generally the same as the preselected distance 52 which facilitates securing the first and second cover members 12 and 14 together at the preselected distance 52. If the ink ribbon 36 has a narrower or wider width, then a narrower or wider set of sleeves 42, 44 and 46 would be selected.

The ribbon cassette 10 further includes bearing means 54 (FIG. 1) located on the first and second cover members 12 and 14. As illustrated in FIG. 1, the bearing means 54 comprises a first seat 54-1 and a second seat 54-2 which are located on the first cover member 12. The bearing means 54 further comprises a third seat 54-3 and a fourth seat 54-4 which are located on the second cover member 14. The function of the bearing means 54 is to rotatably receive and support a ribbon supply spool 56 (FIGS. 1, 2 and 5) and a ribbon take-up spool 58 between the first and second cover members 12 and 14 when the first and second cover members 12 and 14 are adjustably and detachably secured to each other. The widths of the ribbon supply spool 56 and ribbon take-up spool 58 generally correspond to the width of the ink ribbon 36. In the embodiment being described, the first and third seats 54-1 and 54-3 have a diameter which is slightly larger than the diameter of the ribbon supply spool 56 in order to provide a "loose fit". Likewise, the second and fourth seats 54-2 and 54-4 have a diameter which is slightly larger than the diameter of the ribbon take-up spool 58. As illustrated in FIG. 1, the ribbon supply spool 56 has a first end 56-1 and a second end 56-2 and the ribbon take-up spool 58 has a first end 58-1 and second end 58-2. When the ink ribbon 36 is mounted on the ribbon supply spool 56 and ribbon take-up spool 58, enough of the ends 56-1, 56-2, 58-1 and 58-2 remain exposed so that they can be received in the seats 54-1, 54-3, 54-2, and 54-4, respectively. In the embodiment being described, the first ends 56-1 and 58-1 extend past the ink ribbon 36 approximately twice the distance that the second ends 56-2 and 58-2 extend past the ink ribbon 36. The ribbon supply spool 56 becomes rotatably supported in the ribbon cassette 10 when the first and third seats 54-1 and 54-3 receive the first and second ends 56-1 and 56-2, respectively. The ribbon take-up spool 58 becomes rotatably supported in the ribbon cassette 10 when the second and fourth seats 54-2 and 54-4 receive the first and second ends 58-1 and 58-2, respectively. The ribbon supply spool 56 includes a supply sprocket 57, and the ribbon take-up spool 58 includes a take-up sprocket 59. The take-up sprocket 59 is driven by drive means (not shown) in a printer (not shown) As best shown in FIG. 5, the ink ribbon 36 is guided from the ribbon supply spool 56, over the first and second rollers 28 and 34, to the ribbon take-up spool 58.

Figure 2:
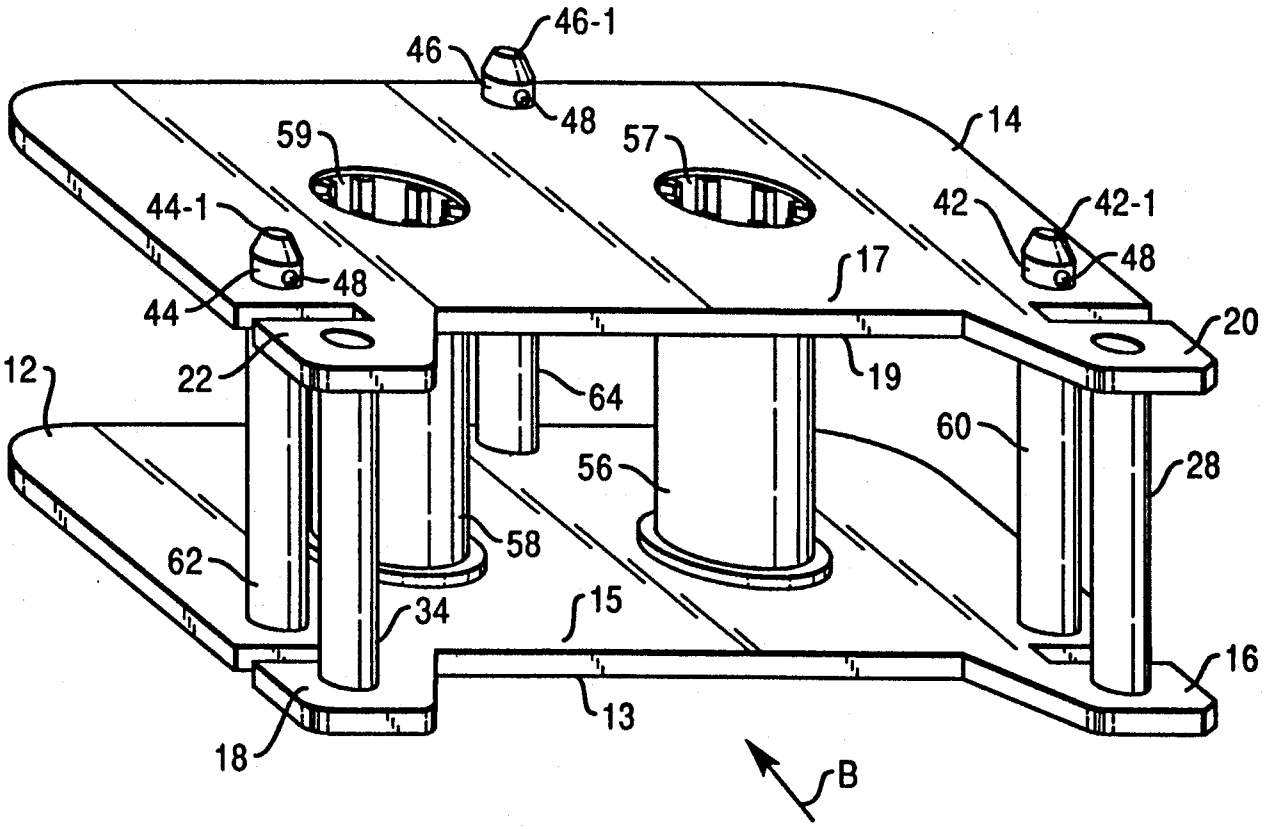
FIG. 2 is a perspective view of the reuseable ribbon cassette, showing the reuseable ribbon cassette assembled, but without any ink ribbon.
Figure 3:
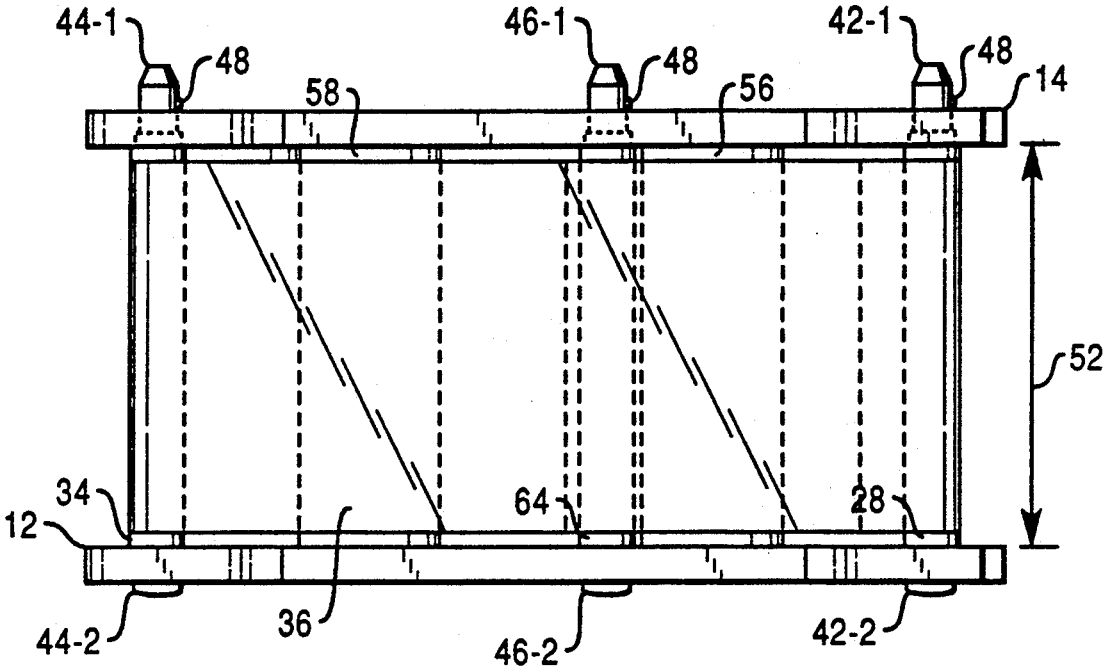
FIG. 3 is a front view of the reuseable ribbon cassette, showing an ink ribbon mounted in the ribbon cassette with the view being taken from the general direction of arrow B in FIG. 2.
Figure 4:
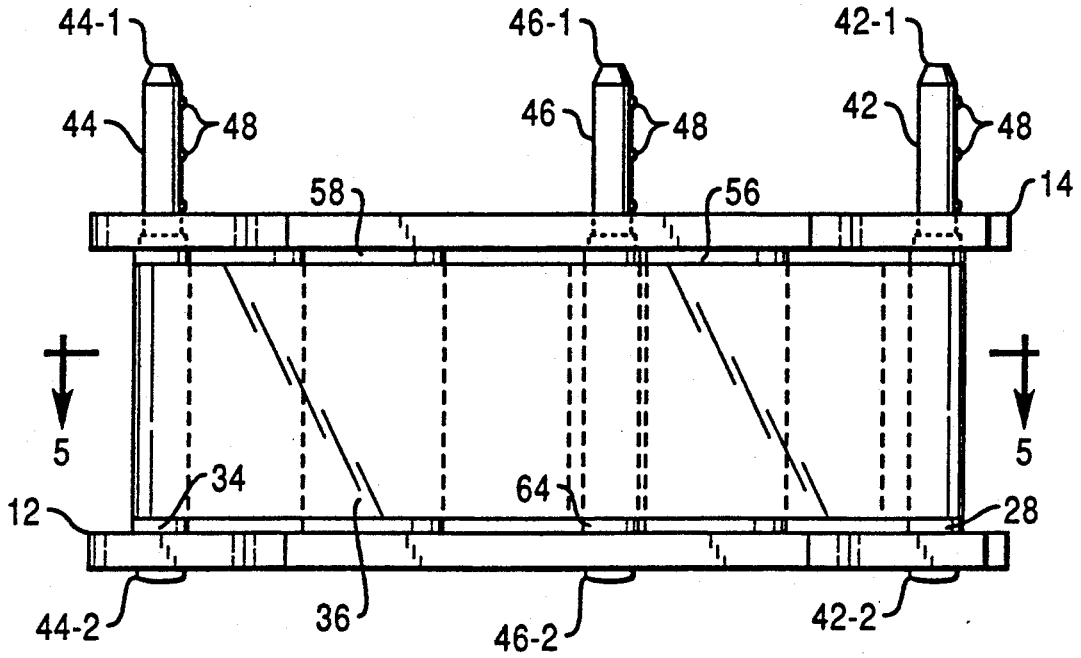
FIG. 4 is another front view of the reuseable ribbon cassette, as shown in FIG. 3, except the ink ribbon in FIG. 4 is narrower than the ink ribbon in the ribbon cassette shown in FIG. 3.

The assembly of the ribbon cassette 10 will now be described. When it is desired to mount the first cover member 12 to the second cover member 14, the ends 42-1, 44-1 and 46-1 are inserted through the first, second and third apertures 12-1, 12-2, 12-3, respectively, until the ends 42-2, 44-2 and 46-2 abut against the first side 13 of the first cover member 12. The first end 56-1 of the ribbon supply spool 56 is then guided into the first seat 54-1 and the first end 58-1 of the take-up spool 58 is guided into the second seat 54-2. As best illustrated in FIG. 5, the ink ribbon 36 is guided from the ribbon supply spool 56 around the first roller 28, around the second roller 34 and then to the take-up spool 58. After the ink ribbon 36 is mounted in the ribbon cassette 10, the first and second rollers 28 and 34 are inserted in the first and third recesses 24 and 30, respectively. The first, second and third sleeves 60, 62 and 64 are place on the first, second and third support posts 42, 44 and 46, respectively. The first and second rollers 28 and 34 are also guided into the third and fourth recesses 30 and 32, respectively, so that the first and second rollers 28 and 34 are supported between the first and second cover members 12 and 14. In order to detachably couple the second cover member 14 to the first cover member 12, the fourth, fifth and sixth apertures 14-1, 14-2, and 14-3 of the second cover member 14 are aligned over the ends 42-1, 44-1 and 46-1, 1, respectively, of the first, second and third support shafts 42, 44, and 46. The second cover member 14 is forced downward until the second ends 56-2 2 and 58-2 of the ribbon supply spool 56 and ribbon take-up spool 58 are received in the third and fourth seats 54-3 and 54-4, respectively, thereby securing the ink ribbon 36 in the ribbon cassette 10. As the second cover member 14 is forced in the direction of arrow A in FIG. 1, the walls 14-1-1, 14-2-1 and 14-3-1 are forced over the detents 48, thereby permitting the second cover member 14 to be adjustably and detachably secured to the first cover member 12, as best shown in FIG. 2. The detents 58 permit the second cover member 14 and the first cover member 12 to be adjustably and detachably secured to each other at the preselected distance 52 (FIG. 3). After the second cover member 14 is secured to the first cover member 12, the first and second cover members 12 and 14 will be in a generally opposed and parallel relationship, as best shown in FIGS. 2-4. When the ribbon cassette 10 is mounted in a printer (not shown) the exposed portion of the ink ribbon 36 lying between the first and second rollers 28 and 34 becomes operatively related to the print station (not shown) in the printer (not shown).

As illustrated in FIG. 4, the first and second cover members 12 and 14 may be adjusted to be closer together, thereby enabling the ribbon cassette 10 to be reuseable and adjustable. The ribbon cassette 10 can accommodate ink ribbons 36 of different widths. When it is desired to remove or replace the ink ribbon 36 from the ribbon cassette 10 in order substitute an ink ribbon 36 having a narrower or wider width, the second cover member 14 is first removed from the first, second and third support shafts 42, 44, and 46. The ribbon supply spool 56 and the ribbon take-up spool 58 are then removed and the new and narrower or wider ribbon supply spool 56 and take-up spool 58 are substituted therefor. Likewise, the first and second rollers 28 and 34 are replaced with narrower or wider rollers 28 and 34, and if used, the first, second and third sleeves 60, 62 and 64 are replaced with narrower or wider sleeves 60, 62 and 64. The second cover member 14 is then remounted on the first, second and third support shafts 42, 44, and 46 in the manner described previously herein. With the narrower or wider ink ribbon 36, a new set of detents 58 on support shafts 42, 44 and 46 are utilized to support the second cover member 14.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. A reuseable ink ribbon cassette which is capable of accommodating ink ribbons having different widths, said reuseable ink ribbon cassette comprising:

a first cover member;

a second cover member;

bearing means located on said first and second cover members for rotatably supporting a ribbon supply spool and a ribbon take-up spool between said first and second cover members when said first cover member is detachably secured to said second cover member; and securing means for adjustably and detachably securing said first cover member and said second cover member a preselected distance away from each other; said preselected distance generally corresponding to the width of the ink ribbon;

said securing means enabling said preselected distance to be adjusted in order to accomodate ink ribbons having different widths.

2. The reuseable ink ribbon cassette as recited in claim 1 wherein said second cover member has a first aperture and a second aperture therein; said securing means comprising:

a first support shaft having a first end and a second end; and a second support shaft having a first end and a second end;

said first ends engaging said first cover member when said first cover member is secured to said second cover member;

said second ends of said first and second support shafts being received by said first and second apertures, respectively, in order to detachably mount said first cover member to said second cover member.

3. The reuseable ink ribbon cassette as recited in claim 2 wherein said second cover member has a third aperture therein;

said securing means further comprising a third support shaft having first and second ends, said first end of said third support shaft also engaging said first cover member when said first cover member is secured to said second cover member;

said third aperture being capable of being slidably mounted over said second end of said third support shaft in order to detachably secure said first cover member to said second cover member.

4. The reuseable ink ribbon cassette as recited in claim 3 wherein said first, second and third support shafts each have a plurality of detents thereon.

5. The reuseable ink ribbon cassette as recited in claim 1 wherein said first and second cover members include guide means for guiding the ink ribbon to a print station of a printer.

6. A reuseable ink ribbon cassette which is capable of accommodating ink ribbons having different widths, said reuseable ink ribbon cassette comprising:

a first cover member;

a second cover member; and securing means for adjustably and detachably securing said first cover member to said second cover member at a preselected distance corresponding to the width of the ink ribbon so that said first cover member is generally opposed and parallel to said second cover member.

7. The reuseable ink ribbon cassette as recited in claim 6 wherein said reuseable ink ribbon cassette further comprises bearing means located on said first and second cover members for rotatably supporting a ribbon supply spool and a ribbon take-up spool between said first and second cover members when said first cover member is detachably secured to said second cover member.

8. The reuseable ink ribbon cassette as recited in claim 7 wherein said second cover member has a first aperture and a second aperture therein; said securing means comprising:

a first support shaft having a first end and a second end; and a second support shaft having a first end and a second end;

said first ends engaging said first cover member when said first cover member is secured to said second cover member;

said first and second apertures being forced over said second ends of said first and second support shafts, respectively, in order to detachably mount said first cover member to said second cover member.

9. The reuseable ink ribbon cassette as recited in claim 8 wherein said second cover member has a third aperture therein;

said securing means further comprising a third support shaft having first and second ends, said first end of said third support shaft also engaging said first cover member when said first cover member is secured to said second cover member;

said third aperture being capable of being slidably mounted over said second end of said third support shaft in order to detachably secure said first cover member to said second cover member.

10. The reuseable ink ribbon cassette as recited in claim 9 wherein said first, second and third support shafts each comprise a plurality of detents.

11. The reuseable ink ribbon cassette as recited in claim 7 wherein said first and second cover members include guide means for guiding the ink ribbon to a print station of a printer.

12. A reuseable ribbon cassette which is capable of accommodating ink ribbons having different widths, said reuseable ribbon cassette comprising:

a first cover member having a first aperture and a second aperture, said first cover member also having first and second arm portions;

a second cover member having a third aperture and a fourth aperture, said second cover member having third and fourth arm portions;

said first and third arm portions each having a recess therein for receiving a first roller and said second and fourth arm portions each having a recess therein for receiving a second roller, said first and second rollers cooperating to guide the ink ribbon to a print station of a printer;

a first support shaft and a second support shaft, said first and second support shafts each having a plurality of detents therein, said first support shaft being capable of being inserted through said first and third apertures and said second support shaft being capable of being inserted through said second and fourth apertures in order to adjustably and detachably secure said first cover member to said second cover member; and bearing means located on said first and second cover members for rotatably supporting a ribbon supply spool and a ribbon take-up spool between said first and second cover members when said first cover member is adjustably and detachably secured to said second cover member;

said securing means permitting said first and second cover members to be detachably and adjustably mounted on said first and second support shafts so that said first and second cover members will be in a generally opposed and parallel relationship and also permitting the distance between said first and second cover members to be adjusted to a preselected distance so that said reuseable ribbon cassette can accomodate ink ribbons having different widths.

13. The reuseable ink ribbon cassette as recited in claim 12 wherein said second cover member has a third aperture therein;

said securing means further comprising a third support shaft having first and second ends, said first end of said third support shaft also engaging said first cover member when said first cover member is secured to said second cover member;

said third aperture being capable of being slidably mounted over said second end of said third support shaft in order to detachably secure said first cover member to said second cover member.

14. The reuseable ink ribbon cassette as recited in claim 13 wherein said first, second and third support shafts each comprise a plurality of detents.

15. The reuseable ink ribbon cassette as recited in claim 12 wherein said first and second cover members include guide means for guiding the ink ribbon to a print station of a printer.

16. A method for using a ribbon cassette to accomodate ink ribbons having different widths, said ribbon cassette comprising a first cover member, a second cover member and a plurality of support shafts; said method comprising the steps of:

(a) inserting the support shafts through said first cover member;

(b) positioning a supply spool of ink ribbon and a take-up spool on the first cover member; and (c) mounting the second cover member on the support shafts at a preselected distance from the first cover member so as to retain the supply spool and the take-up spool between the first and second cover members;

said preselected distance generally corresponding to the width of said ink ribbon.

17. The method as recited in claim 16 wherein said inserting step (a) includes the step of:

(a)(1) providing support shafts each comprising a plurality of detents.

18. The method as recited in claim 16 wherein, when it is desired to change the ink ribbon, said method further comprises the steps of:

(d) removing the second cover member from the support shafts;

(e) replacing the supply spool of ink ribbon and the take-up spool with a new supply spool and a new take-up spool of ink ribbon having a different width; and (f) repeating said step (c).

* * * * *